US012031305B2

(12) United States Patent
Pourzynal et al.

(10) Patent No.: US 12,031,305 B2
(45) Date of Patent: Jul. 9, 2024

(54) BACKWATER FLOW DETECTION METHOD

(71) Applicant: Backwater Solutions Canada Inc., Ottawa (CA)

(72) Inventors: Payk Pourzynal, Ottawa (CA); James Henderson, Gatineau (CA); Yih-Shyang Tsai, Kanata (CA)

(73) Assignee: Backwater Solutions Canada Inc., Ottawa (CA)

( * ) Notice: Subject to any disclaimer, the term of this patent is extended or adjusted under 35 U.S.C. 154(b) by 57 days.

(21) Appl. No.: 18/066,897

(22) Filed: Dec. 15, 2022

(65) Prior Publication Data

US 2023/0128644 A1 Apr. 27, 2023

Related U.S. Application Data

(62) Division of application No. 17/233,023, filed on Apr. 16, 2021, now Pat. No. 11,560,697.

(60) Provisional application No. 63/011,610, filed on Apr. 17, 2020.

(51) Int. Cl.
*E03B 7/07* (2006.01)

(52) U.S. Cl.
CPC ..... *E03B 7/072* (2013.01); *E03B 7/077* (2013.01)

(58) Field of Classification Search
CPC . E03B 7/072; E03B 7/077; E03B 7/04; E03B 7/00
USPC ..... 137/514–514.7; 251/48–55
See application file for complete search history.

(56) References Cited

U.S. PATENT DOCUMENTS 10,563,382 B1 * 2/2020 Leverich ..... E03B 7/072
10,697,848 B1 * 6/2020 Dobbs ..... E03B 7/04

* cited by examiner

*Primary Examiner* — Paul J Gray

(57) ABSTRACT

A backwater flow detection device for detecting backwater flow between a building and a sewer conduit using air pressure detection in air pockets in the sewer conduit. The backwater flood detection device detects backwater flow events including backflow events from a sewer line as well as wastewater blockage events that can result in wastewater backflow into a building. The water detection sensor allows the homeowner or building manager to be warned when there is an issue with backwater flow in or near the building, and also with the backwater valve.

20 Claims, 9 Drawing Sheets

BACKWATER FLOW DETECTION METHOD

CROSS-REFERENCE TO RELATED APPLICATIONS

This application claims priority to U.S. provisional patent application 63/011,610 filed on 17 Apr. 2020, and is a divisional application of U.S. Ser. No. 17/233,023 filed on 16 Apr. 2021, both of which is are hereby incorporated by reference herein in their entirety.

FIELD OF THE INVENTION

The present invention pertains to a backwater flood detection device for detecting a backwater flow event. The backwater flood detection device detects backwater flow events including backflow events from a sewer line as well as wastewater blockage events that can result in wastewater backflow into a building.

BACKGROUND

In a building or other structure serviced via an underground sewer line sewage and drainage lines act as a conduit to direct sewage toward a municipal sewer. Drainage flow is directed from the building to the sewer, however on occasion these sewage and drainage lines back up between the building and the sewer, either at the main sewer line or at the branch line leading from the building to the main sewer line. When the drainage line becomes clogged or blocked with debris, ice, or as a result of build-up inside the pipe, a flooding event can occur in the building if adequate precautions are not taken. Flooding events such as overflow of the sewer lines, reservoirs, or other water conduits can also cause back up in the sewer line, which can result in sewer water backflowing into the building. For example, sudden heavy rainfall can cause the city sewer lines to be overwhelmed and can cause water and/or sewage to flow back towards the building.

A backwater valve is a device that is installed between a municipal drainage or sewer system and the building to prevent backflow of sewer water from the municipal sewer system to the building. A backwater valve sits inside a home's branch or main sanitary sewer line, and its job is to prevent sewage from returning up a sanitary sewer line and entering the building basement. Backwater valves are designed to allow water or sewage to flow only one way, that is, out of the building and toward the municipal drainage system, and generally contain a gate or physical barrier to allow wastewater to exit the building but not enter. In a backflow event, the gate or barrier of the backwater valve is designed to close to prevent water backflow towards the building and into building plumbing system such as sinks, toilets and showers. However, these gates and barriers can accumulate biofilms, crud, debris, and can get blocked themselves, and require cleaning on a regular basis to ensure proper function. Without maintenance and cleaning, improperly functioning backwater valves can lead to exactly the condition that they are meant to solve, namely sewer backflow into the building. Many homeowners and building managers do not realize that their buildings have backwater valves, and over time malfunction can lead to significant basement water damage.

Various types of backwater valves exist for preventing backflow of water from a sewer into a building. In one example, U.S. Pat. No. 9,725,894 describes a sewer conduit having a moisture sensor for detecting the level of fluid and an inflatable bladder mounted for releasably sealing in fluid tight fashion a section of the sewer conduit inflatable with a compressed air source responsively to conduit fluid level conditions reaching beyond a pre-set threshold value.

In another example, U.S. Pat. No. 10,533,312 describes blockage detection using a backwater valve by detecting fluid undulations inside the main body of the backwater valve. A predetermined magnitude of undulations within a predetermined time period, measured by monitoring a buoyant gate and sensor on the gate, triggers an alarm.

Detection of backwater flow can further assist in prevention of sewer backflow. There remains a need for a backwater flood detection device for detecting a backwater flow event into a building including backflow events from a sewer line as well as wastewater blockage events that can result in wastewater backflow into a building.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide backwater flow detection device for detecting backwater flow towards a building in a sewer conduit using air pressure detection in air pockets in the sewer conduit.

In an aspect there is provided a backwater flow detection device in a sewer system comprising: a backwater device comprising an inflow line receiving water from a building and an outflow line for directing water out of the building; a sealed air cavity above the inflow line and the outflow line; an air pressure sensor in the sealed air cavity for detecting air pressure changes in the sealed air cavity; a microcontroller for receiving data from the air pressure sensor; and a local communication connection between the microcontroller and a network to report air pressure in the sealed air cavity, wherein an increase in air pressure in the sealed air cavity is indicative of a blockage in the sewer system.

In an embodiment, the local communication connection comprises a wireless communication interface.

In another embodiment, the device further comprises a battery to power the air pressure sensor and local communication connection.

In another embodiment, the device further comprises a backflow valve to seal at least one of the inflow line and the outflow line.

In another embodiment, the backflow valve is an expandable balloon, sealing flange, float, door, gasket, gate, or combination thereof.

In another aspect there is provided a method for detecting backwater flow in a sewer system comprising: detecting air pressure in a sealed air cavity above a sewer conduit; receiving data comprising the detected air pressure in the sealed air cavity at a microcontroller; and reporting the detected air pressure through a communication network, wherein an increase in air pressure in the sealed air cavity is indicative of a blockage in the sewer system.

In an embodiment, the method further comprises relaying the reported detected air pressure through a local network.

In another embodiment, the method further comprises sending a signal to close a backwater valve in the sewer system.

In another embodiment, the method further comprises alerting a municipality, utility, security company, maintenance company, insurance company, building manager, or homeowner, of the occurrence of one or more backwater flow events.

In another embodiment, the method further comprises collecting air pressure data from one or more buildings.

In another embodiment, the method further comprises detecting air pressure adjacent a plurality of buildings and identifying one or more buildings that are local outliers of high air pressure to identify building sewer systems that require maintenance.

In another embodiment, the method further comprises creating a backwater heat map indicating regions of frequent backwater flow events.

In another aspect there is provided a backwater flow detection device for a backwater valve comprising: a housing comprising: an air pressure sensor for detecting air pressure changes in a sealed air cavity of the backwater valve; a microcontroller for receiving data from the air pressure sensor; and a local communication connection between the microcontroller and a network to report air pressure in the sealed air cavity, wherein an increase in air pressure in the sealed air cavity is indicative of a blockage in the sewer system.

In an embodiment, the local communication connection comprises a wireless communication interface.

In another embodiment, the device further comprises a battery to power the air pressure sensor and local communication connection.

In another embodiment, the housing is configured to be attached to a standard backwater valve cleanout cap.

In another embodiment, the housing comprises one or more clip, clamp, aperture, or adhesive for attachment to the backwater valve cleanout cap.

BRIEF DESCRIPTION OF THE FIGURES

For a better understanding of the present invention, as well as other aspects and further features thereof, reference is made to the following description which is to be used in conjunction with the accompanying drawings, where.

DETAILED DESCRIPTION OF THE INVENTION

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or element(s) as appropriate.

As used herein, the terms "connect" and "connected" refer to any direct or indirect physical association between elements or features of the present disclosure. Accordingly, these terms may be understood to denote elements or features that are partly or completely contained within one another, attached, coupled, disposed on, joined together, in communication with, operatively associated with, etc., even if there are other elements or features intervening between the elements or features described as being connected.

Herein is described a backwater flow detection device for detecting backwater flow towards a building. Detection of backwater flow can further assist in prevention of sewer backflow in individual buildings as well as in regions that suffer from sewer overflow. The backwater flood detection device described detects backwater flow events including backflow events from a sewer line as well as wastewater blockage events that can result in wastewater backflow into a building. The backwater detection sensor will allow the homeowner or building manager to be warned when there is an issue with backwater flow in or near the building, and also with a backwater valve. This device will also allow data collection on residential communities to monitor, track, and predict when and where a flood situation might occur such that mitigation and communication measures can be taken to reduce or prevent building water damage and backflow.

The present backwater flow detection device can be used in a wide variety of buildings including but not limited to single dwelling homes, semi-detached units, condominium units or collections of condominium units, apartment buildings, other residential buildings, and commercial buildings. Other applications of the present device include locations in a clean water supply, sanitary sewer system, or storm water sewer system, or combined sanitary and storm water sewer system, where detection of pressure inside the system is desirable. The backwater flow detection device can also be used in septic systems such as cottages, farms, and rural buildings that are connected to a local septic system.

Figure 1:
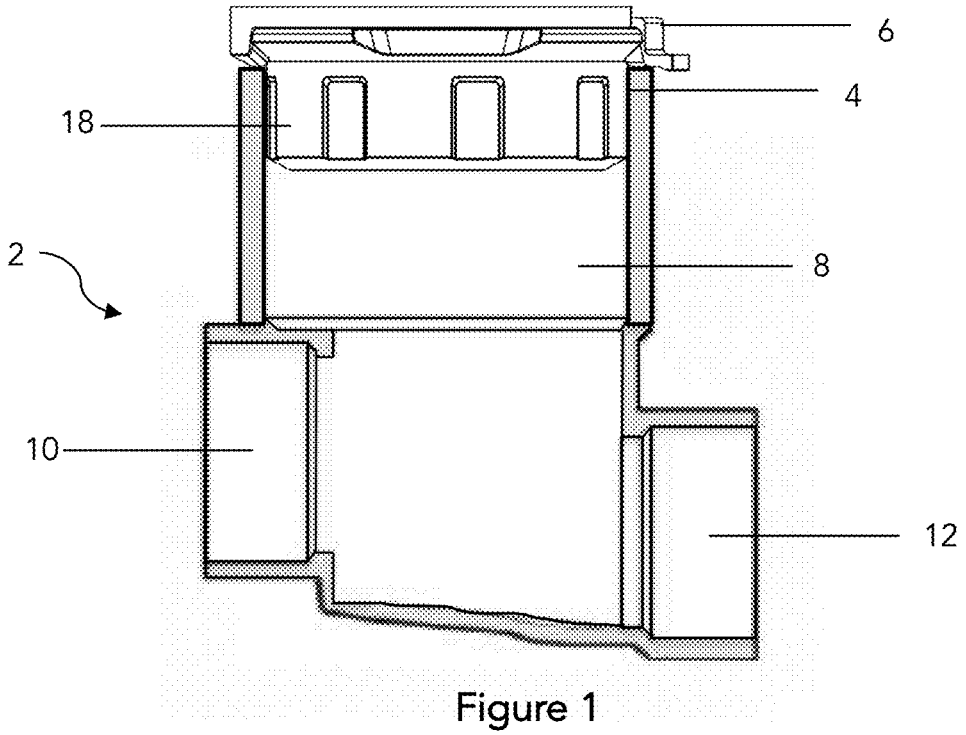
FIG. 1 illustrates an example of a backwater flow detection device.

FIG. 1 illustrates an example of a backwater flow detection device which acts as a sewer and drainage conduit from a building to a municipal sewer. Sewer and drainage water from the building flows from a pipe to the backwater flow detection device 2 through inflow line 10 at a downward slope, and out of the backwater flow detection device 2 through outflow line 12 to the sewer. A sealed cavity 8 above the water flow conduit, comprising the inflow line 10 and outflow line 12, extends upwards to provide an air pocket with rigid walls that can withstand an increase in air pressure detectable by the backwater flow sensor 18. A cleanout port 4 provides access to the sealed cavity 8 through cleanout cap 6. The size and shape of the sealed cavity 8 can be variable in diameter, cross-section, height, etc. as long as the cavity can accommodate a pressure sensor and provide a sealed chamber such that differences in pressure can be detected by the backwater flow sensor 18. In normal flow conditions water and sewage will occupy only the bottom part of the water flow conduit and the air pressure in the backwater flow detection device will be equalized with ambient pressure in the air gap in the sewage plumbing system. When the water level rises during backup, overflow, or flood conditions, water in and around the backwater flow detection device will create a seal with the conduit and/or piping around the conduit and further inflow of water into the backwater flow detection device will cause the volume of the air pocket inside the sealed cavity 8 to compress and the pressure in the sealed cavity 8 to rise. The rise in pressure in the sealed cavity 8 is detected by the backwater flow sensor 18 and reported to a control system which can communicate the backflow event alarm to a homeowner, building occupant, building manager, municipality, communication centre, and/or other connected user or device. In addition, the pressure rise can trigger other events in the plumbing system, such as control of one or more shut off valves between the building and municipal sewer line to shut off the sewage water flow, either at the backwater flow detection device or somewhere else along the line between the building and the sewer system to prevent or limit backwater flow into the building.

Figure 2:
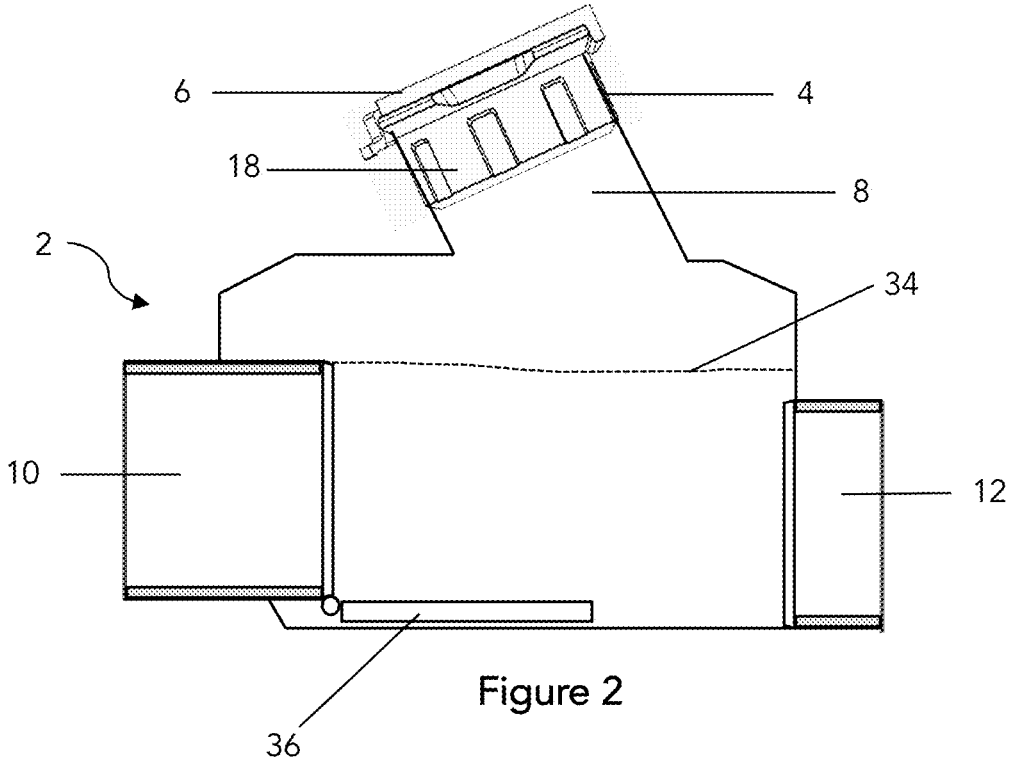
FIG. 2 illustrates an example of a backwater flow detection device with a backwater gate valve.

FIG. 2 illustrates an example of a backwater flow detection device which acts as a sewer and drainage conduit from a building to a municipal sewer, fitted with a backwater gate valve to block backwater from flowing toward the building. The built-in drainage slope of the backwater flow detection device 2 ensures that under normal conditions building wastewater will flow in the main conduit in a downward direction toward the sewer, from inflow line 10 from the building to outflow line 12 to the sewer. A sealed cavity 8 above the main conduit is generally filled with air and provides access to the backwater flow detection device 2 through cleanout port 4 via removal of cleanout cap 6. In this case, the sealed cavity 8 is raised relative to the water flow conduit comprising the inflow line 10 and outflow line 12 to provide a larger air pocket above the maximum capacity water level 34. In addition, the cleanout port 4 which provides access to the interior of the backwater flow detection device for inspection, cleaning, and maintenance, is angled towards the building. The backwater flow sensor 18 is positioned in the sealed cavity 8 and incorporated into the cleanout port 4 above the maximum water level 34 in the backwater flow detection device such that a rise in water level higher than the capacity of the outflow line 12 will result in an increased pressure in the sealed cavity 8 that is detectable by a pressure sensor in the backwater flow sensor 18. This backwater flow detection device is also fitted with a sealing gate 36, which in this case is a buoyant gate that is mobile and whose angle can change based on the amount of water in the bottom of the backwater flow detection device.

When backflow from the sewer flows upstream, the backwater valve or gate 36 will float up with the rising the water and seal inflow line 10 to prevent backwater from entering the building. Various other inflow line gates are also known and include but are not limited to gates biased in a downward and closed direction with a hinge mounted on the top on the seal inflow line 10 to allow water to leave the building but not return, and gates as shown with a hinge at the bottom of the inflow line 10 which are biased in an downward direction to allow water to leave the building but are buoyant and block the inflow line 10 when water in the main conduit rises. Other barriers are known that can block the flow of water in the backwater system including expandable balloons, sealing flanges, float systems, doors with an optional float, gaskets, gate, and combinations thereof, optionally electronically controlled, which can be placed at a variety of locations in the backwater system. These can also be all mechanical or optionally electrically controlled. In all cases, when there are moving parts in a plumbing system, in particular in a sewer system which has a large amount of carried particulate and biological matter, regular maintenance and cleaning of these systems is important to ensure that any gates or barriers are working properly. Without proper maintenance, backwater valves can become blocked or stuck, giving building managers and homeowners a false sense of security that they will be protected during a flooding event.

During a storm or flooding event, sanitary wastewater from a home trying to flow back into a home causes a working backwater valve to close its flap. This action prevents sewage from reentering the home, but it also means that water from inside the home can't get out until the valve reopens. It is important that when the valve closes the sewer line the home or building occupants do not use the toilet, sink, shower, washer, dishwasher, or anything else that discharges wastewater, because the wastewater will have nowhere to go except up the floor drain and into the building basement. However many homeowners and residents are not aware of the presence or operation of a backwater valve, and if the valve is closed due to a flooding event or blockage many residents will not be aware of it until sanitary sewage begins flowing back into their building. By detecting the air pressure in a sewer conduit and triggering an alarm, occupants can be made aware of an impending backwater event and take steps to mitigate or avoid damage caused by backwater flooding events.

Figure 3:
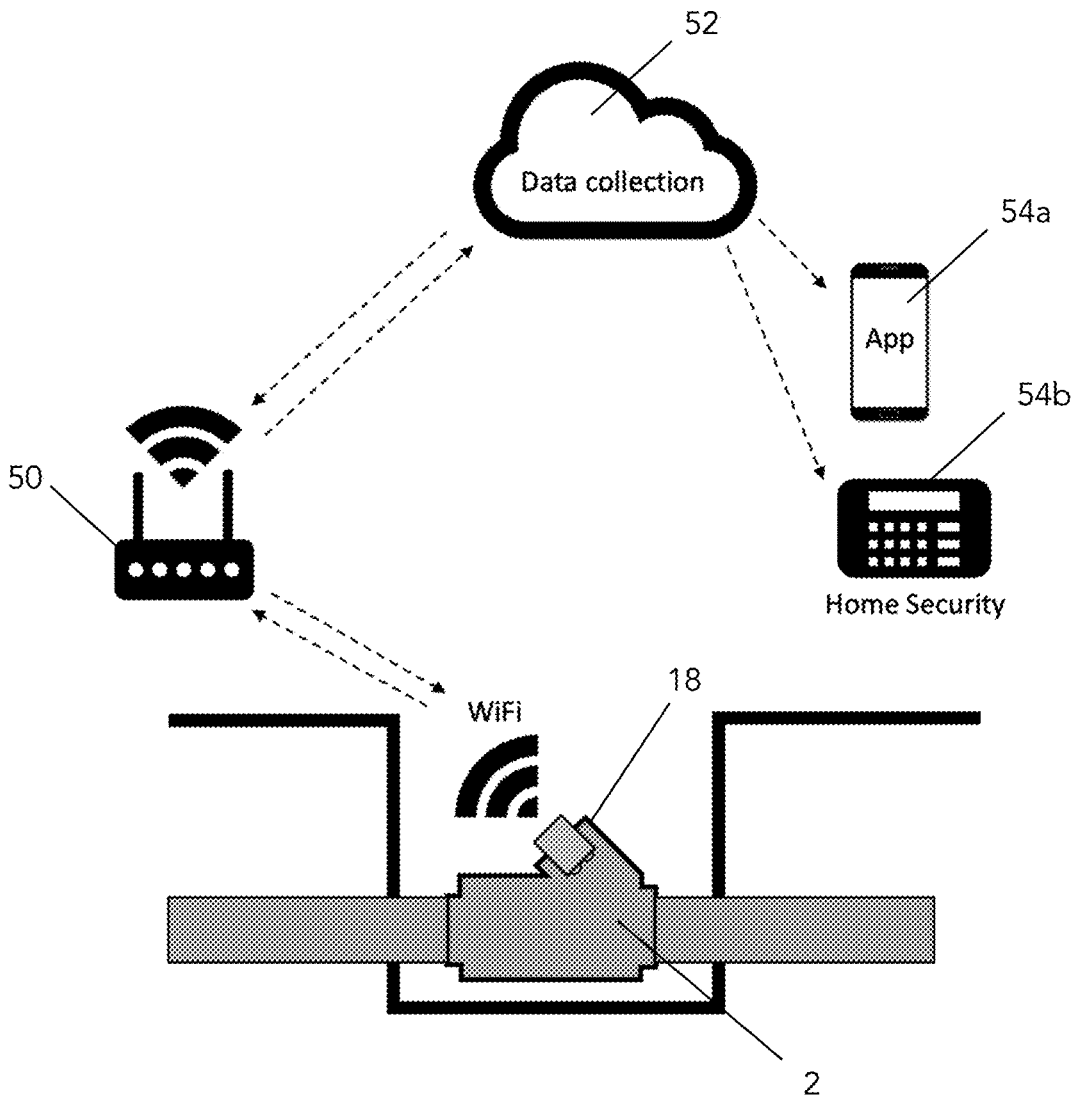
FIG. 3 illustrates connectivity of a backwater flow detection device.

FIG. 3 illustrates an example connectivity of a backwater flow detection device in a networked system. Backwater flow detection device 2 is placed in the ground between a building and the municipal sewer line. Backwater flow sensor 18 positioned in backwater flow detection device 2 is configured to detect a rise in air pressure in the backwater flow detection device 2 and report the pressure change wirelessly to a nearby connected device. The backwater flow detection device 2 is communicatively coupled over a local communication channel to a central hub 50 which is itself communicatively coupled to a local data collection hub 52 and/or the Internet. Preferably the communication channel is wireless, such as, for example, Wi-Fi, bluetooth, cellular signal, Z-wave, mesh network, wireless ad hoc network, other radiofrequency, or other wireless connection, to connect to the local network or security system for the building. The communication connection may also be a wired connection. The backwater flow detection device 2 may initially be paired to the central hub 50 using a known pairing technique to enable a local communication channel between the backwater flow detection device 2 and the data collection hub 52. In one embodiment, the network includes an end user database for maintaining user account information and data collected from each backwater flow detection device 2. For example, the end user database may be regularly updated to store the data collected by the backwater flow detection device 2 to provide data on normal pressure fluctuation, abnormal pressure changes indicating a backwater flow event, and changes in pressure patterns to detect when maintenance and/or cleanout is required. The data stored in the database may then be made accessible to the end user via an electronic device 54*a*, 54*b* such as an app, browser, building security system, building smart thermostat system, or other remote system, to provide data and information on the functioning of the sewage water conduit for the building. The same data can be shared with one or more control system to control other valves in the drainage system to prevent sewer water backflow. In addition, data can be shared with utilities and municipalities to monitor local backwater flow events at multiple locations in neighbourhoods to provide additional information to monitor and control water levels and prevent flood damage caused by sewer water blackflow from municipal sewer systems.

Figure 4A:
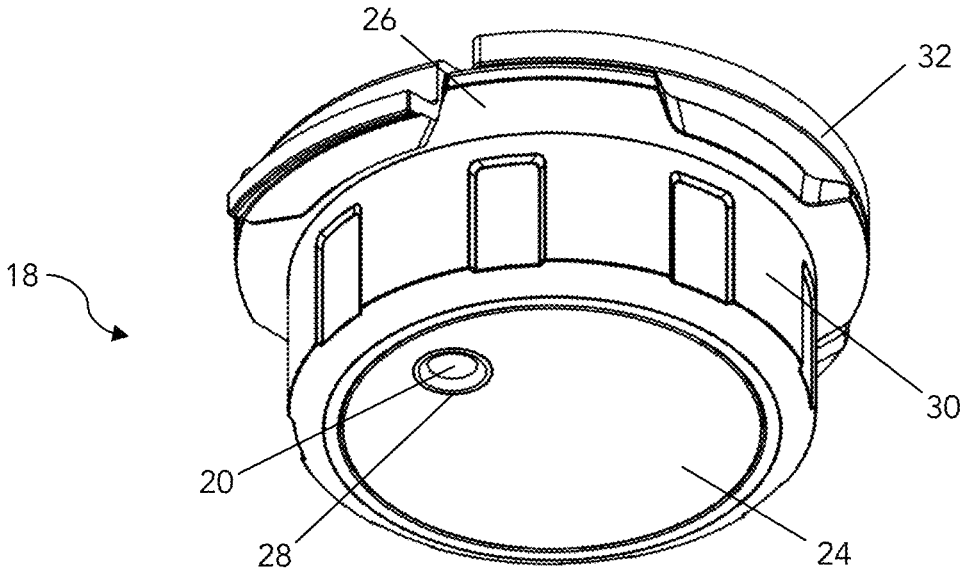
FIG. 4A is an isometric view of a backwater flow sensor.

FIG. 4A is an isometric view of an example of backwater flow sensor 18 which is positioned in an air cavity in a water conduit of a water backflow conduit system or backwater flow detection device. The backwater flow sensor 18 shown has a mounting plate 32 which can be attached to or integrated into the cleanout cap of a water conduit which seals the cleanout port in a backwater valve device. The backwater flow sensor 18 shown is configured to be attached to a standard cleanout cap of a conduit or backwater valve device, providing the conduit or valve has sufficient space in the cleanout port to provide a sealed air cavity. Any attachment method may be used, including but not limited to one or more clips, screws, clamps, adhesives, or any other attachment means known. The backwater flow sensor 18 can also be integrated into a cleanout cap such that replacement of an existing cleanout cap can be done easily with a standard sized cleanout cap with sensor capability. Alternatively, the flow sensor can be integrated into the body of the backwater conduit and separated from the cleanout cap or cleanout port. For example, the air pressure sensor can be located at any location that provides an air cavity, and is preferably located at an accessible location from the outside such that the parts can be accessed for cleaning, maintenance, repair, or replacement. Air pressure sensor 20 is positioned in sensor aperture 28 in housing cap 24 to protect the sensor. Interior housing 26 provides an interior location for supporting and mounting the flow sensor components such as the communication component(s), power supply and/or battery, and electronics required to power, control, and connect the air pressure sensor. Locking ring 30 around housing 26 provides a relatively air and water tight seal to protect the components in the wet and fluctuating conditions inside the sewer conduit system.

Figure 4B:
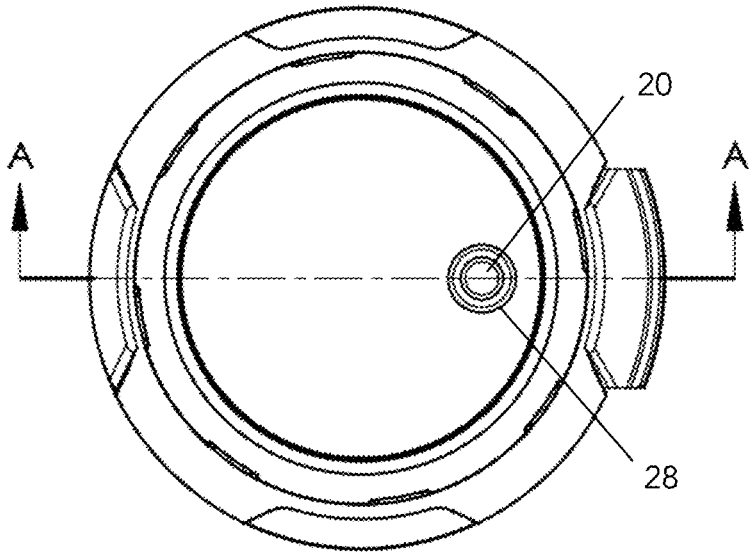
FIG. 4B is a bottom view of a backwater flow sensor.

FIG. 4B is a bottom view of a backwater flow sensor comprising an air pressure sensor 20 in sensor aperture 28 in the housing cap. The sensor aperture 28 can be flush with the air pressure sensor, or can alternatively have a recess and/or air permeable shield to further protect the air pressure sensor from disturbance or soiling from the sewer conditions. Surface treatment of the area around the sensor aperture, and optionally also of the sensor, can provide further protection from fouling and biofilm growth to prolong the lifetime of the sensor.

Figure 5:
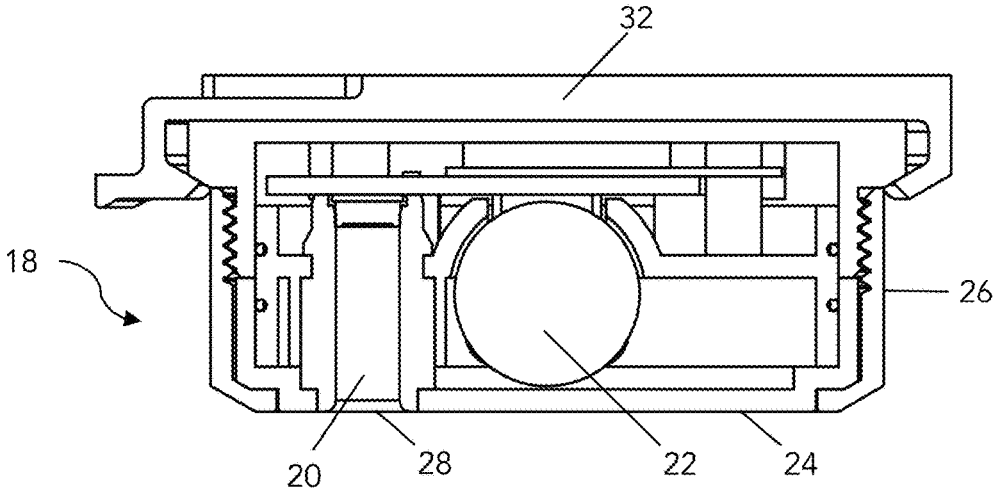
FIG. 5 is a side cross-sectional view of a backwater flow.

FIG. 5 is a side cross-sectional view of a backwater flow sensor 18 through A-A' in FIG. 4B. Internal housing 26 provides a secure cradle to house the components of the backwater flow sensor 18 and protect the components from the harsh conditions of the sewer conduit system. Preferably internal housing 26 provides a waterproof enclosure to provide protection of the electronics inside. Air pressure sensor 20 is exposed to the outside through sensor aperture 28 in housing cap 24. Battery 22 is held in a battery compartment in the internal housing 26. Preferably battery power can be provided by the battery to power the backwater flow sensor at a sufficient Wi-Fi power including acceptable signal strength for at least six months, and is replaced during bi-yearly scheduled cleanings and maintenance. Alternatively, the backwater flow sensor 18 can have a wired power connection.

Figure 6:
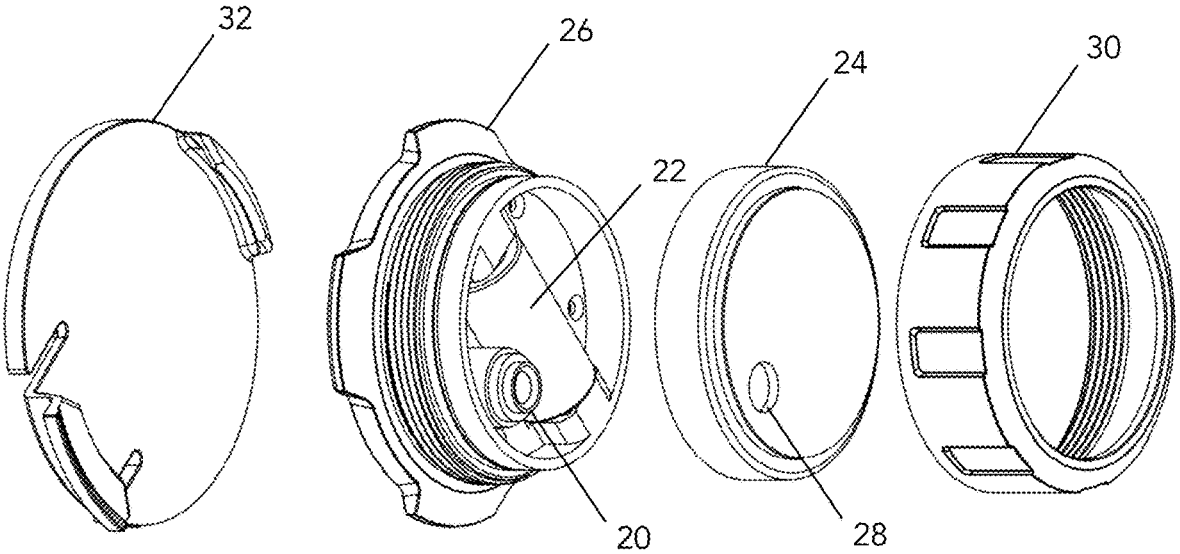
FIG. 6 is an exploded view of a backwater flow sensor.

FIG. 6 is an exploded view of an embodiment of a backwater flow sensor. Air pressure sensor 20 fits inside a chamber in internal housing 26, which also houses battery 22 in a battery compartment. Housing cap 24 fits over internal housing 26 to provide a seal for the electronics and also provides a sensor aperture 28 as an external port through which the air pressure sensor 20 can detect pressure changes in the immediate environment in the sealed cavity around the backwater flow sensor. Locking ring 30 tightens the housing cap 25 to the internal housing 26, and can be removed for replacement of the battery 22, maintenance, or cleaning of the backwater flow sensor. Mounting plate 32 provides a locus to mount the backwater flow sensor to a cleanout cap or other surface inside a sewer conduit. In one embodiment, the air pressure sensor is capable of sensing high resolution changes in air pressure as well as water pressure. The sensor module can include a high linear pressure sensor providing pressure and temperature values and different operation modes that allow the user to optimize for conversion speed and current consumption. Additionally, a high resolution temperature output can allow for the implementation of a depth measurement systems and thermometer function without any additional sensor. One example sensor that can be used is a TE Connectivity MS5803-14BA sensor. The sensor can be interfaced to a microcontroller with simple communication protocol. Surface protection of the sensor, optionally with a cover or gel and optional stainless steel or other protective cap can provide additional water, fouling, and corrosion resistance.

Figure 7:
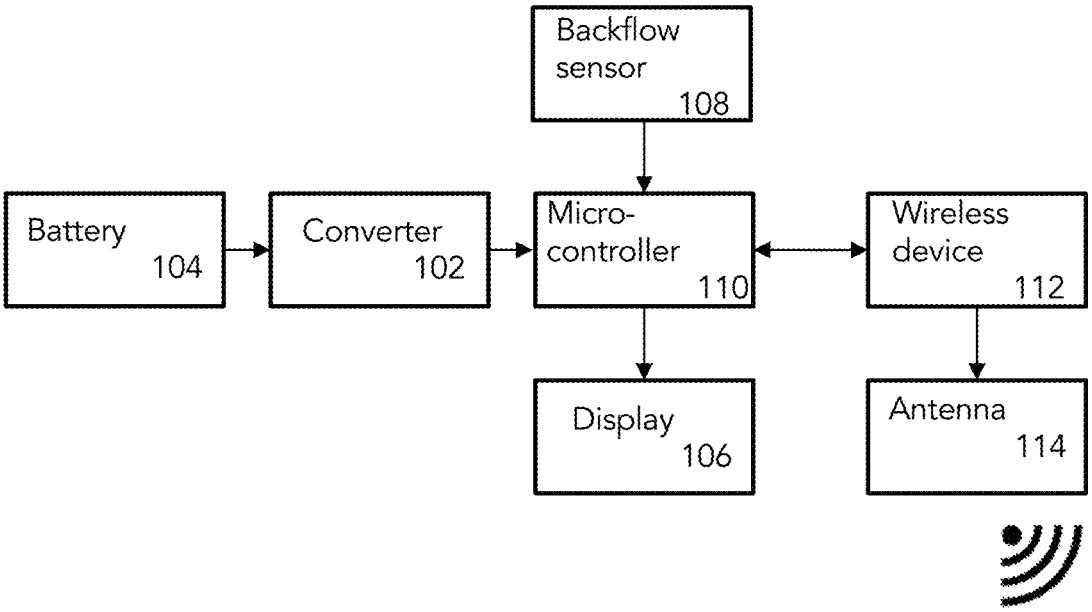
FIG. 7 is a functional block diagram of a wireless backwater flow sensor.

FIG. 7 is an example functional block diagram of a wireless backwater flow sensor. Backflow sensor 108 which comprises at least a pressure sensor is powered by a battery 104 connected to a microcontroller 110 through a boost converter 102. Optional display 106 can provide details on the sensor operation and can comprise one or more LED lights, displays, screens, or combinations thereof. Microcontroller 110 or microcontroller unit is a small computer containing one or more CPUs or processor cores along with memory and one or more programmable input/output peripherals. Program memory can also be included on the microprocessor chip, as well as memory. The microcontroller is capable of data collection from the sensor and of simple calculations to determine the state of the water in the system and relay this information to a bluetooth or other wireless device 112, for example, and also optionally to the display 106. Antenna 114 can further relay data from the microcontroller to a remote central hub for additional processing, communication, and/or routing.

Figure 8:
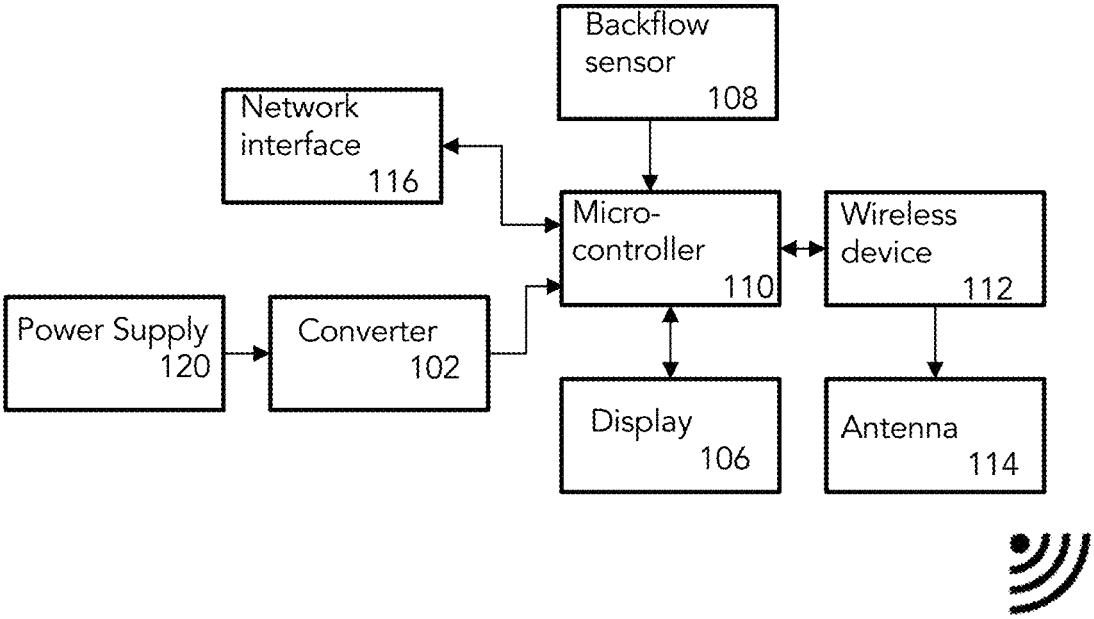
FIG. 8 is a functional block diagram of a wired backwater flow sensor.

FIG. 8 is a functional block diagram of another version of a backwater flow sensor. Network interface 116 can connect to the microcontroller 110 through a registered jack, which is a standardized physical network interface for connecting telecommunications or data equipment. A wired power supply 120 from a DC supply is converted using a boost converter 102. Network interface 116 can connected through an ethernet connection. The gateway can either wired or wireless, or both wireless and wired to allow for situations when wireless does not work such as when the device is unable to connect with a wireless router and the device needs to instead connect via wired ethernet. Microcontroller 110 is connected to sensor 108, and optionally to display 106. All of the components should be sufficiently durable to withstand standard weather and temperature conditions in sewer building conduit systems, with an operating temperature ranging at least from 0° C. to +120° C. and have a humidity resistance to protect any sensitive electronics. Bluetooth or other wireless device 112 provides low power usage in a wireless personal area network technologies with reduced power consumption and cost while maintaining a communication range capable of connecting wirelessly at low power with the building. Antenna 114 provides a relay to the personal area network, and is preferably a patch antenna is a type of radio antenna with a low profile which can be mounted on a flat or limited surface.

Figure 9A:
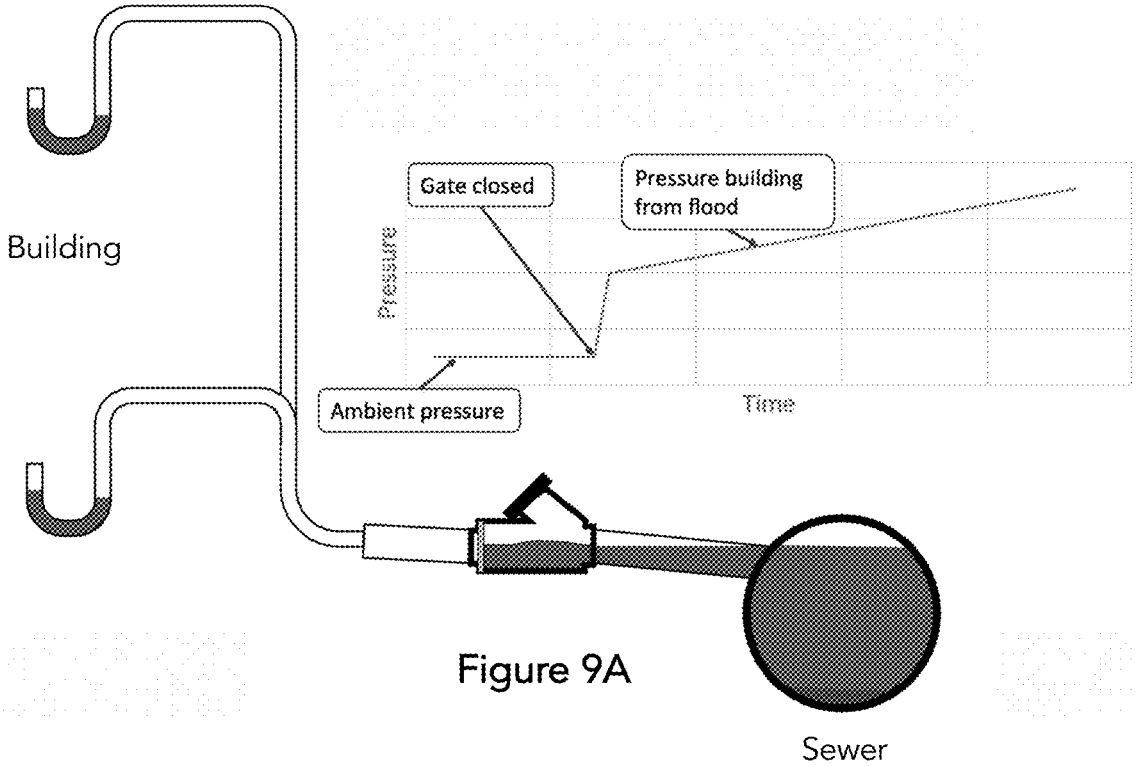
FIG. 9A illustrates a backwater flow condition caused by an overfilled sewer and closed backwater valve gate.

FIG. 9A illustrates a backwater flow condition caused by an overfilled sewer with backwater flow sensor pressure jump caused by a closed valve gate. In this situation, the municipal sewer is at a high level and backflow from the sewer is filling up the drainage line between the sewer and the house or building causing a backflow valve to close. As the water rises the gate closes in the backwater valve, after which a spike in pressure is detected in the sealed cavity of the backwater flow detection device. The backflow valve closure then results in an accumulation of air pressure in the backwater detection device, with pressure building in the detection device and compression of the air pocket above the water level in the drainage system. This type of scenario is common in flooding events in low lying regions, in regions where the water table is high, in regions close to water bodies that can overflow, in sewer systems that are undersized for the capacity that they serve, during flooding weather events, and in other conditions where the municipal sewer system is overwhelmed with water capacity. In this case, when the backwater valve to the building is closed, building occupants should be aware that sewer water generated in the building has nowhere to go and therefore should limit or stop water use to prevent backflow of generate sewage into the building until the water level in the sewer has subsided and water can flow normally.

Figure 9B:
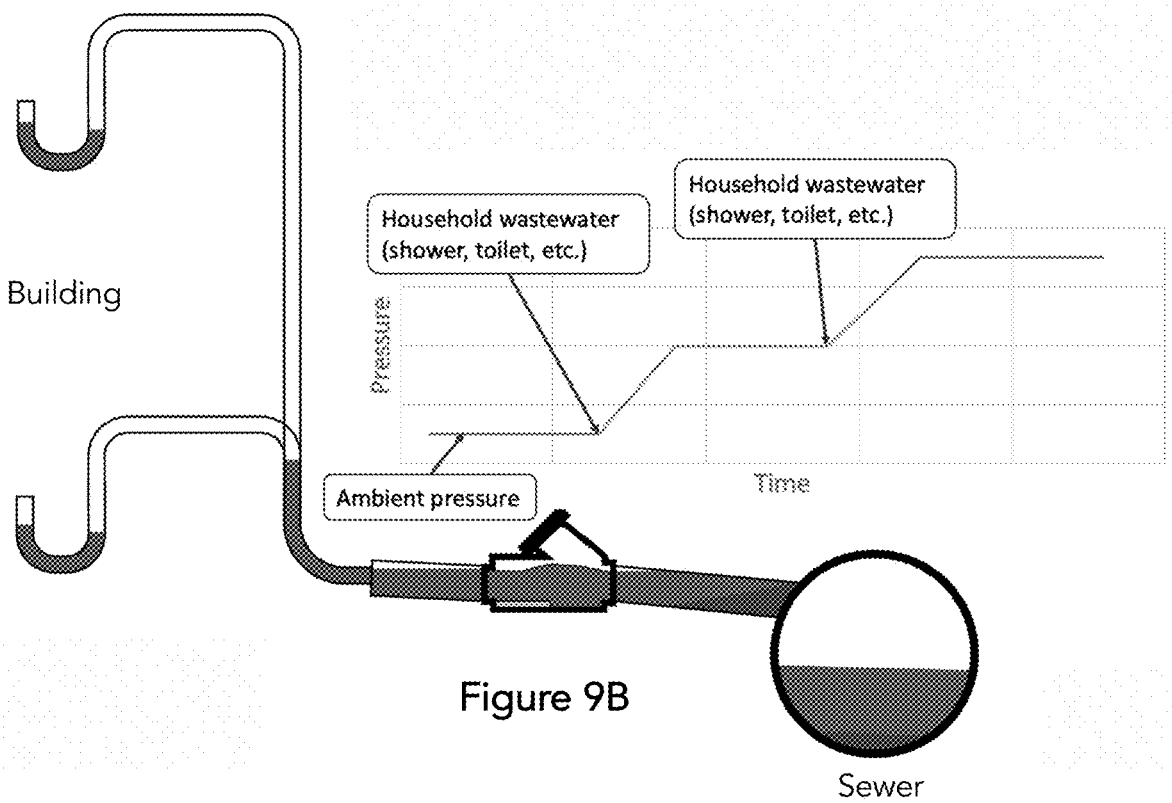
FIG. 9B illustrates a backwater flow condition caused by a blockage in the sewer line.

FIG. 9B illustrates a backwater flow condition caused by a blockage in the sewer line with backwater flow causing a pressure jump. Such scenarios can occur when the sewer conduit has been blocked by detritus, and/or accumulation or buildup around the interior of the drainage pipes which can occur without regular maintenance and monitoring of the sewer drainage lines. With a blockage in the drainage sewer conduit, sewage water from the building sent through the building drain is either limitedly or fully blocked from entering the municipal sewer and has nowhere to go. In this case a backwater flow sensor pressure jump is caused by accumulation of water between the sewer and building, indicating an imminent risk of backwater flooding. A graph of pressure versus time shows how as the water rises with the pressure on the air pressure sensor remaining at ambient until the sealed cavity in which the air pressure sensor is mounted is sealed off by the rising water. In this case the water from the building continues to flow toward the municipal sewer but is blocked from entering the sewer causing sewer water accumulation in the drainage conduits. When air is trapped inside the backwater flow detection device, pressure in the device is detected indicating that a backflow event is imminent without proper precautions being taken in the building. This causes a flood condition, where blockage of the drainage from the building causes pressure buildup between the municipal sewer and the building, putting the building at risk of a backwater flood. As the water rises the backwater valve gate remains open, however water continues to accumulate between the sewer and the building. Once the conduit lines seal the sealed cavity in the backwater flow detection device a spike in pressure is detected in the sealed cavity. Further rising water levels increase the local pressure which is detected by the air pressure sensor.

Figure 10:
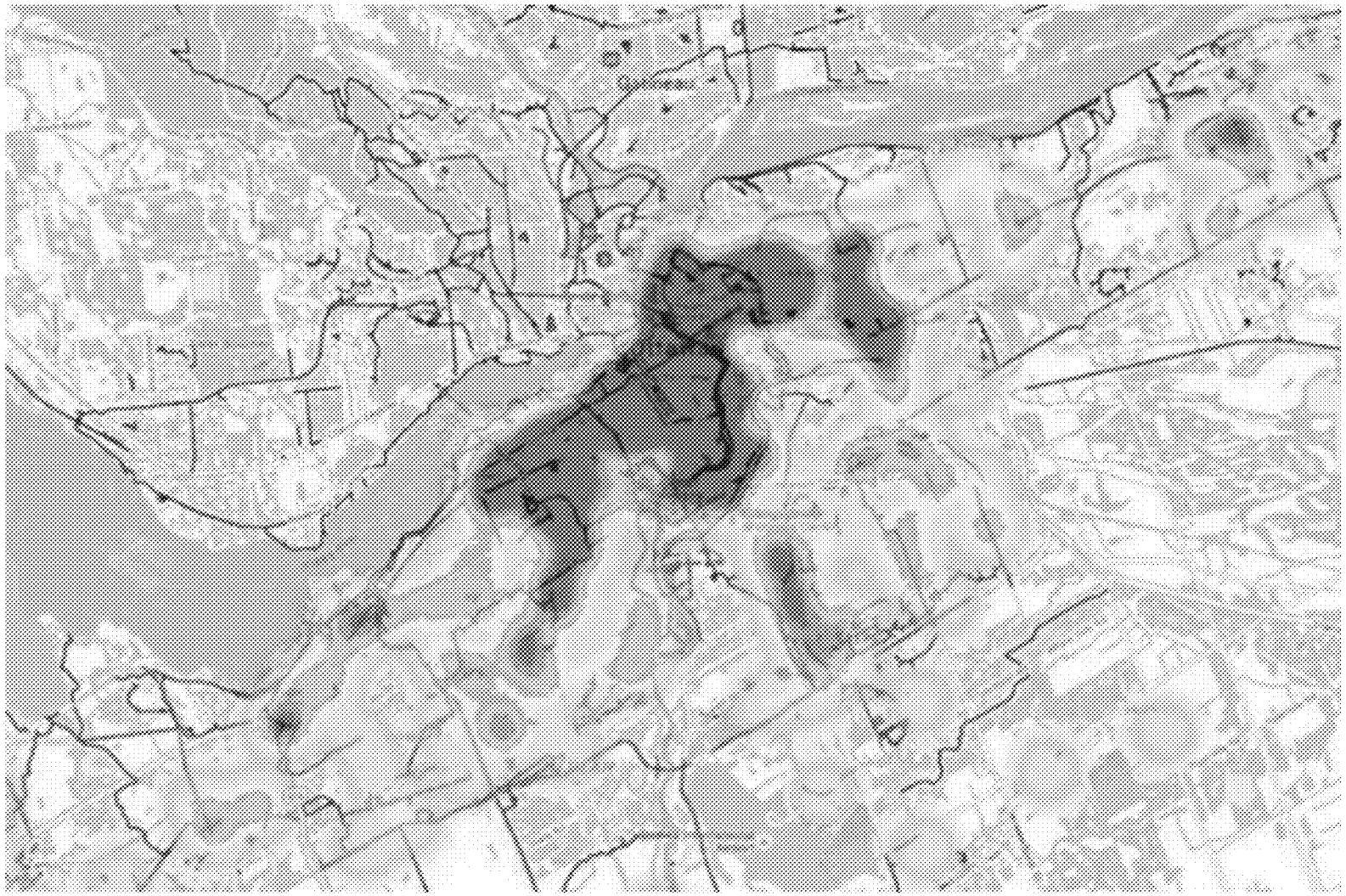
FIG. 10 is a flood map which can be generated from a network of backwater flow detection devices.

FIG. 10 is a flood map which can be generated from a network of backwater flow detection devices. Locations where flooding is occurring as detected by the network of backwater detection devices can be mapped, where darker areas indicate increased occurrence of increased air pressure in the flow detection devices and/or blockage events. Data can be additionally mapped based on, for example, number of alarms triggered per area, increase in pressure in the networked devices, triggered valves in the network, etc. The shown pressure map of the network of backwater flood detection devices in a given area can may also be able to create a heat map style dataset set that shows pressure gradients during a flood. Analysis of pressure fluctuation data may also be helpful to identify flood sources in a given area, locations where backwater events are more frequent, as well as identification of individual buildings that are outliers in a given area that would be good candidates for sewer line investigation, maintenance, and replacement to prevent backflow events. In another case, if a backflow event is detected at one or more buildings in a neighbourhood, the system can pre-emptively shut down one or more backwater valves in buildings other than the building detecting backflow to prevent flooding in neighbouring buildings.

During a flooding event, interpreting the sensor data, in particular water and/or air pressure over time, optionally also including temperature, can provide more detailed analysis of the profile of the backwater flow event. In addition to an increase in pressure providing information on detecting an imminent flood condition, measurement of pressure over time can provide information on the flood rate or timing of the potential flooding event. Monitoring of decreasing pressure in the system can indicate the speed at which the water is being drained from the blocked area with steady pressure decrease and the rate of decrease providing additional information on the integrity of the sewer and drainage lines. In a situation where sewage flow from the building has stopped entirely such that no water is being added to the system, an increase in pressure over time can indicate the location of the blockage and cause of the blockage, further indicating that the flood condition is worsening. Maintenance notifications can further notify insurance companies that the building has had scheduled cleanings and maintenance as required. This could be done via battery changes, pressure data collection and correlation. Flood Mitigation Analysis can further be combined with environmental data (e.g. high water levels, extreme rain events), could indicate effectiveness of flood mitigation techniques (drainage system, sandbagging, dam gate settings, etc.)

The sensor described herein is preferably an air pressure sensor, however it is understood that the same can be used to detect water pressure in the system. It is noted that the air pressure sensor can also be capable of detecting increases in water pressure as well as fluctuations in temperature of the air or water or both. In addition, other sensor types can further be integrated into the backwater flow sensor device, including, for example, temperature sensors for sensing water temperature, sensors for sensing water depth or distance to a surface such as an ultrasonic sensor, and other types of motion sensors. Other sensors that can be used in conjunction with pressure and/or temperature sensors include but are not limited to optical sensors including a camera and/or LED to allow imaging of the valve or conduit for obstruction and/or event monitoring, and flow direction sensors such as motion sensors or ultrasonic sensors to detect if water starts to flow in the direction of the building. In one example, a temperature sensor can provide data on temperature over time, and rises or spikes in temperature may indicate types of household water use at a given time, such as shower, dishwasher, or washing machine use, which can provide additional information on building water usage. Temperature fluctuations and differentials between building outflow water and sewer water can also provide additional information on potential backflow risks, such as, for example, potential freezing risk which can lead to blockage. A combination of pressure and temperature measurements in the drainage line could also indicate that a blockage exists between the backwater conduit or valve and the city main or municipal sewer line. This type of data in combination with valve status and in-building overflow data can assist in backflow risk mitigation and provide immediate information on whether a backflow event is imminent or already occurring. Various other sensors can be combined with the sensor of the present device, including, for example, electro-mechanical sensors, capacitive sensors, and chemical sensors. In another example, an air quality sensor can be used to measure specific gases in the air pocket as an indicating of overall sewer system health and operation.

Figure 11:
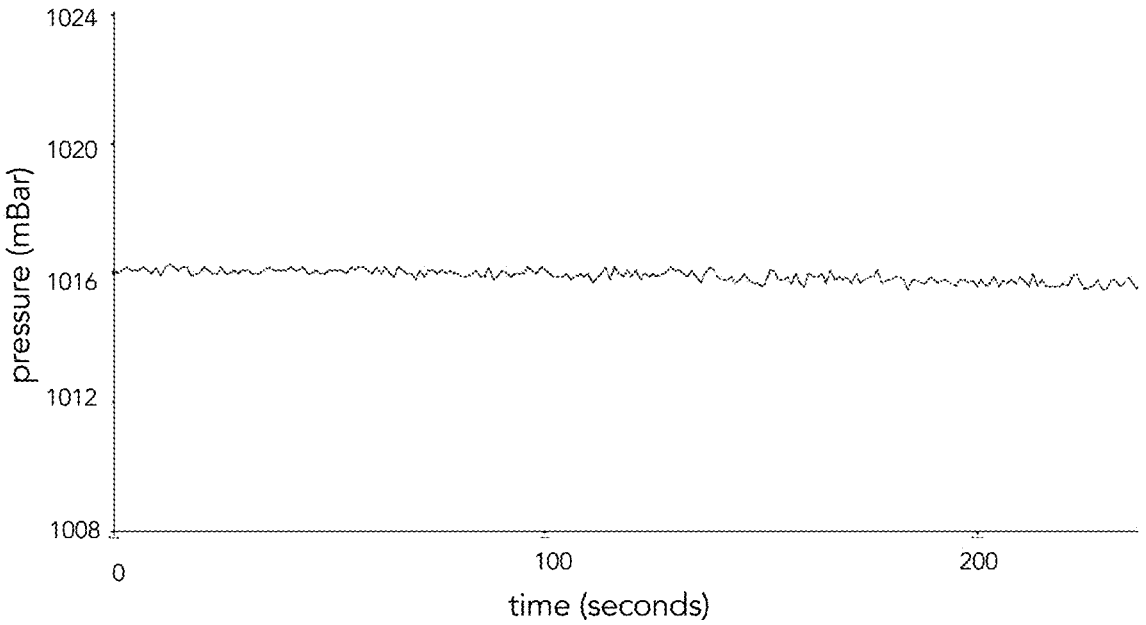
FIG. 11 is a graph of a backwater flow sensor under normal flow conditions.
Figure 11:
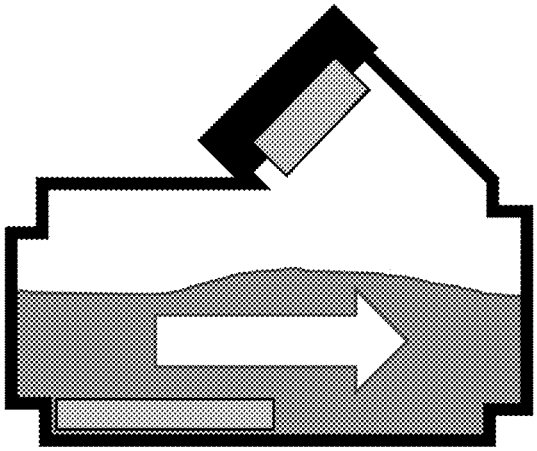

FIG. 11 is a graph of pressure vs. time in a backwater flow pressure sensor under normal flow conditions. Under normal pressure and flow conditions when the water is flowing away from the building the pressure the cavity above the inflow line and outflow line is not sealed and the air pressure sensor detects the ambient pressure.

Figure 12:
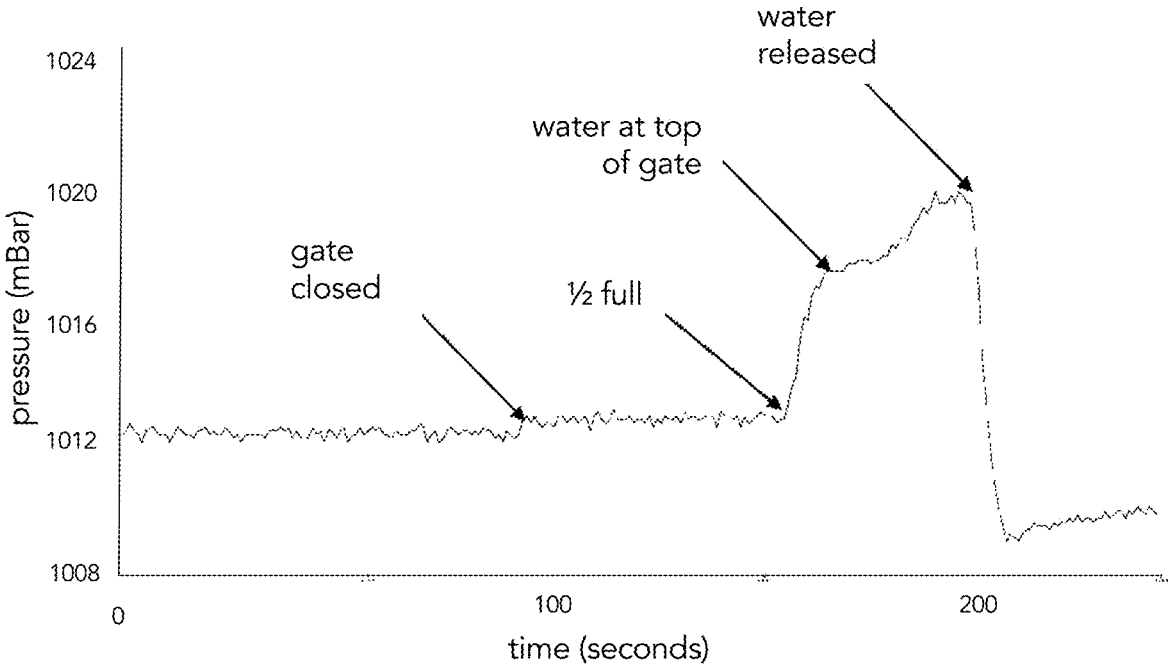
FIG. 12 is a graph of a backwater flow sensor under a backwater flow condition.
Figure 12:
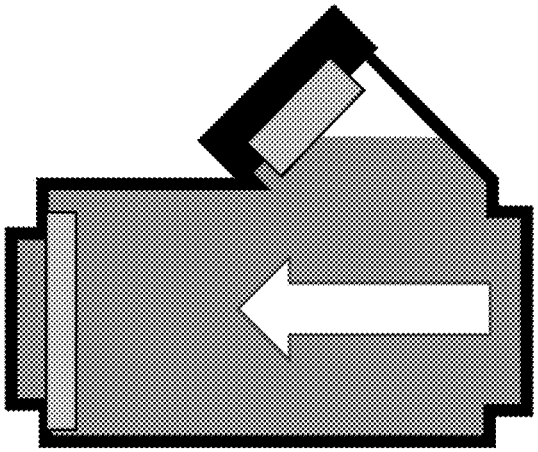

FIG. 12 is a graph of pressure vs. time in a backwater flow pressure sensor under a backwater flow condition. In a backwater flow condition water flows toward the building and the gate of the backwater flow detection device closes the inflow line to prevent water from entering. Backflow water then fills the outflow line and the cavity above the water conduit is sealed, which increased the pressure in the cavity. The pressure increase is detected by the backwater flow sensor which detects a rise in pressure which can be reported as a potential flood event to an alarm or reporting system. The pressure and pressure rise over time can be reported to the external system to indicate the water level, as well as how fast the water is rising. When water is released from the backwater flow detection device a decrease in pressure at the backwater flow pressure sensor is detected and can be reported.

Although the present backwater flow device is described as being useful between a building and a municipal sewer system, it is also understood that the same could be used in the absence of a municipal sewer line, such as in septic systems which can also suffer blockages and result in backflow. In addition, it is understood that the same may be used in any location in a water conduit system where detection of an increase in air or water pressure is desirable.

All publications, patents and patent applications mentioned in this specification are indicative of the level of skill of those skilled in the art to which this invention pertains and are herein incorporated by reference. The invention being thus described, it will be obvious that the same may be varied in many ways. Such variations are not to be regarded as a departure from the scope of the invention, and all such modifications as would be obvious to one skilled in the art are intended to be included within the scope of the following claims.

We claim:

1. A method for detecting backwater flow in a sewer system comprising:

detecting air pressure in a sealed air cavity above a sewer conduit adjacent a plurality of buildings;

receiving data comprising the detected air pressure in the sealed air cavity at a microcontroller;

reporting the detected air pressure through a communication network; and identifying one or more buildings that are local outliers of high air pressure to identify building sewer systems that require maintenance, wherein an increase in air pressure in the sealed air cavity is indicative of a backwater flow event in the sewer system.

2. The method of claim 1, further comprising relaying the reported detected air pressure through a local network.

3. The method of claim 1, further comprising sending a signal to a control system to close a backwater valve in the sewer system.

4. The method of claim 1, further comprising alerting one or more of a municipality, utility, security company, maintenance company, insurance company, building manager, and homeowner, of the occurrence of a backwater flow event.

5. The method of claim 1, further comprising collecting air pressure data from one or more buildings.

6. The method of claim 1, further comprising creating a backwater heat map indicating regions of frequent backwater flow events.

7. The method of claim 1, further comprising detecting one or more of temperature of water in the sewer conduit and water pressure in the sewer conduit.

8. The method of claim 1, wherein the communication network is connected to a control system capable of triggering an alarm in response to detected increase in air pressure by the air pressure sensor in the sealed air cavity.

9. The method of claim 1, wherein the communication network is connected to a control system to control of one or more shut off valves to shut off water flow through the sewer conduit.

10. The method of claim 1, wherein the communication network is connected to the microcontroller through one or more of a wired connection, Wi-Fi, bluetooth, cellular signal, Z-wave, mesh network, wireless ad hoc network, and radiofrequency connection.

11. The method of claim 1, wherein the sewer conduit is in a municipal sewer system.

12. The method of claim 1, further comprising generating a flood map of backwater flow events in a location where flooding is occurring as detected by a plurality of backwater flow events in the sewer system.

13. The method of claim 1, wherein the sealed air cavity is in a backwater flow detection device connected to the sewer conduit, the backwater flow detection device having an upper water level limit below the sealed air cavity, wherein air pressure is detected in the sealed air cavity above the upper water level limit.

14. The method of claim 13, further comprising detecting a position of a buoyant gate in the backwater flow detection device.

15. The method of claim 13, wherein the sewer system comprises a plurality of backwater flow detection devices.

16. The method of claim 1, wherein the sewer conduit is in one or more of a low lying region, in a region where the water table is high, in a region close to a water body that can overflow, and in a sewer system that is undersized for the capacity that it serves.

17. The method of claim 1, further comprising detecting air pressure in a plurality of locations in a sewer conduit thereby detecting when a sewer system is overwhelmed with water capacity.

18. The method of claim 1, further comprising storing air pressure data collected by the backwater flow detection device in a database.

19. The method of claim 17, further comprising making data stored in the database available on one or more of an electronic device, app, browser, building security system, building smart thermostat system, or other remote electronic system.

20. The method of claim 1, further comprising analysing air pressure data to detect normal pressure fluctuation, abnormal pressure changes indicating a backwater flow event, or changes in pressure patterns to detect when maintenance is required.

* * * * *